US011167548B2

(12) United States Patent
Noda

(10) Patent No.: US 11,167,548 B2
(45) Date of Patent: Nov. 9, 2021

(54) PRINTER

(71) Applicant: Ricoh Company, Ltd., Tokyo (JP)

(72) Inventor: Eiji Noda, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/902,868

(22) Filed: Jun. 16, 2020

(65) Prior Publication Data

US 2021/0016562 A1 Jan. 21, 2021

(30) Foreign Application Priority Data

Jul. 18, 2019 (JP) ..... JP2019-132443

(51) Int. Cl.
*B41J 2/045* (2006.01)

(52) U.S. Cl.
CPC ..... *B41J 2/04505* (2013.01); *B41J 2/04586* (2013.01)

(58) Field of Classification Search
CPC ..... B41J 2/04505; B41J 2/04586
See application file for complete search history.

(56) References Cited

U.S. PATENT DOCUMENTS

| | | | | |
|---|---|---|---|---|
| 9,025,196 | B2 * | 5/2015 | Moriya | B41J 3/4078 358/1.5 |
| 10,821,754 | B2 * | 11/2020 | Watanabe | B41J 11/002 |
| 2011/0298876 | A1 | 12/2011 | Takeuchi et al. | |
| 2012/0086762 | A1 | 4/2012 | Noguchi et al. | |
| 2012/0242768 | A1 | 9/2012 | Seno et al. | |

FOREIGN PATENT DOCUMENTS

| | | |
|---|---|---|
| JP | 2004-144832 | 5/2004 |
| JP | 2017-193136 | 10/2017 |
| JP | 2018-122304 | 8/2018 |
| WO | WO2014/207007 A1 | 12/2014 |

* cited by examiner

*Primary Examiner* — Thinh H Nguyen
(74) *Attorney, Agent, or Firm* — Xsensus LLP

(57) ABSTRACT

A printer includes a mount on which a print target is placed, a print device to print an image on the print target on the mount, a print area indicator around a periphery of the mount, the print area indicator to indicate a print area of the image to be printed on the print target on the mount, and control circuitry to control the print area indicator to indicate the print area according to a print start position from which the print device starts printing on the print target and a print size of the image to be printed on the print target.

9 Claims, 4 Drawing Sheets

PRINTER

CROSS-REFERENCE TO RELATED APPLICATION

This patent application is based on and claims priority pursuant to 35 U.S.C. § 119(a) to Japanese Patent Application No. 2019-132443, filed on Jul. 18, 2019, in the Japan Patent Office, the entire disclosure of which is hereby incorporated by reference herein.

BACKGROUND

Technical Field

Aspects of the present disclosure relate to a printer.

Related Art

A printer of a flatbed type includes, for example, a mount (also referred to as a bed, a stage, or a table, etc.) on which a print target is placed and a print device such as a liquid discharge head. The printer moves and scans the print device in a main-scanning direction and a sub-scanning direction to perform printing on the print target. The printer of the flatbed type is also referred to as the "flatbed printer."

The flatbed printer includes a camera and projector system including a camera system and a projector system. The projector system covers at least an entire surface of a flatbed as a projection area. The projector system of the flatbed printer projects a digital image on a surface of the flatbed to indicate to an operator a position of a flat medium piece on which the digital image is to be printed. The flat medium piece is an example of the print target.

SUMMARY

In an aspect of this disclosure, a printer includes a mount on which a print target is placed, a print device to print an image on the print target on the mount, a print area indicator around a periphery of the mount, the print area indicator to indicate a print area of the image to be printed on the print target on the mount, and control circuitry to control the print area indicator to indicate the print area according to a print start position from which the print device starts printing on the print target and a print size of the image to be printed on the print target.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
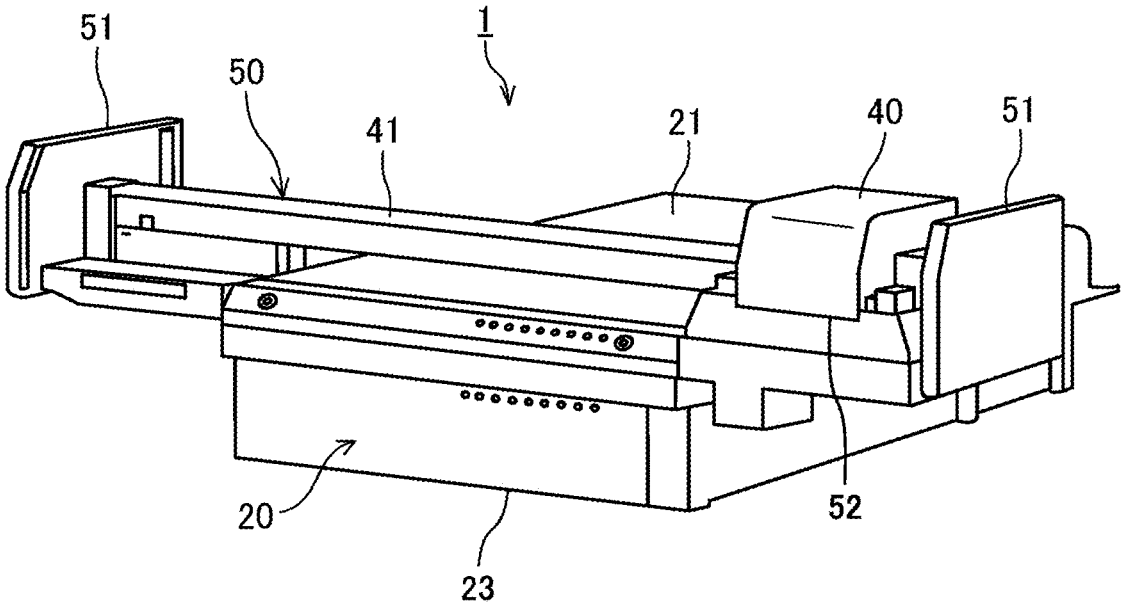
FIG. 1 is a schematic perspective view of a printer according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a," "an," and "the" are intended to include the plural forms as well, unless the context clearly indicates otherwise.

Figure 2:
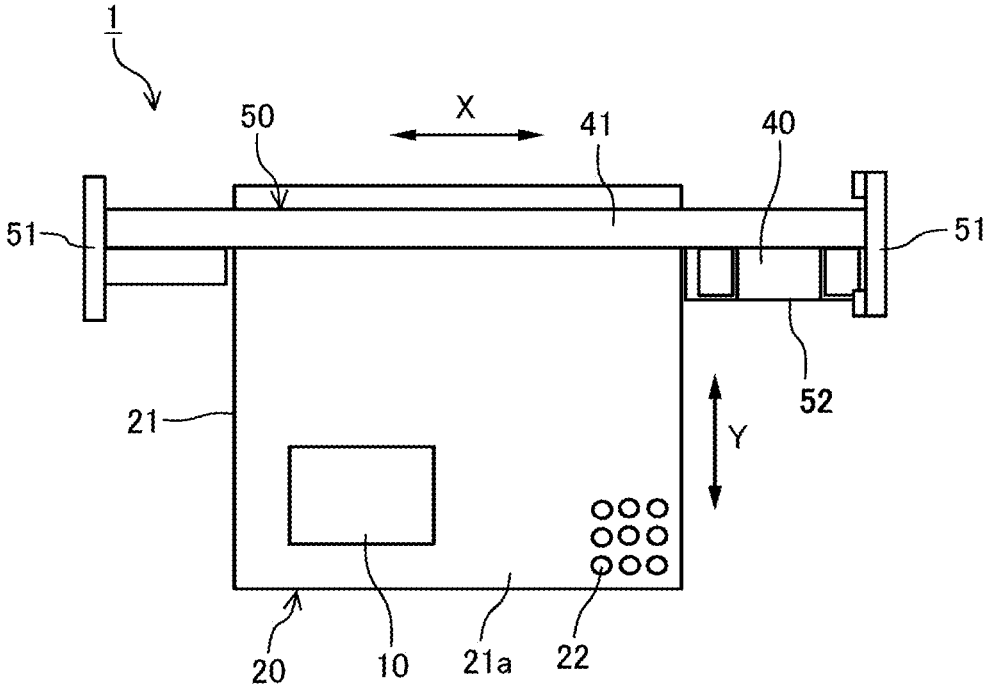
FIG. 2 is a schematic plan view of the printer of FIG. 1.

Referring now to the drawings, wherein like reference numerals designate identical or corresponding parts throughout the several views, embodiments of the present disclosure are described below. Next, a first embodiment of the present disclosure is described with reference to FIGS. 1 and 2. FIG. 1 is a schematic perspective view of a printer 1 according to a first embodiment of the present disclosure. FIG. 2 is a schematic plan view of the printer 1 of FIG. 1.

The printer 1 includes an apparatus body 20 that includes a bed 21 (also referred to as stage or table) as a mount on which a print target 10 is placed.

As illustrated in FIG. 2, the bed 21 includes a plurality of suction holes 22 (only part of which is illustrated). The printer 1 includes a suction device in a structure body 23 of the apparatus body 20 to generate a suction force on a mounting surface 21*a* of the bed 21 so that the print target 10 placed on the bed 21 is attracted to the mounting surface 21*a* of the bed 21. The bed 21 may be configured to attract the print target by electrostatic attraction, for example.

The printer 1 includes a gantry 50 that reciprocally movably holds a carriage 40 in a first direction X (main-scanning direction) with respect to the mounting surface 21*a* of the bed 21. The gantry 50 movably holds the carriage 40 in the first direction X by a main scanning member 41 spanned between both side plates 51. The carriage 40 mounts a print device such as a liquid discharge head 52 to discharge a liquid from nozzles to form (print) an image on the print target 10. However, the print device is not limited to the liquid discharge head 52. Hereinafter, the "liquid discharge head" is simply referred to as the "head."

The gantry 50 is reciprocally movable relative to the mounting surface 21*a* of the bed 21 in a second direction Y (sub-scanning direction) perpendicular to the first direction X. Thus, the gantry 50 is relatively movable with respect to the mounting surface 21*a* of the bed 21. The printer 1 includes a sub-scanning encoder sensor in the gantry 50. The sub-scanning sensor reads and controls a movement of the gantry 50. The sub-scanning encoder sensor includes a sub-scanning encoder sheet at both side ends of the apparatus body 20.

The printer 1 suctions and fixes the print target 10 placed on the mounting surface 21*a* of the bed 21 onto the mounting surface 21*a* of the bed 21. Then, the printer 1 discharges a liquid from the head 52 to form one line of an image while reciprocally moving the carriage 40 in the first direction X (main-scanning direction). Then, the printer 1 moves the gantry 50 by one line in the second direction (sub-scanning direction) to form an image of the next line. The printer 1 repeats the above-described operations to print a desired image on the print target 10.

Figure 3:
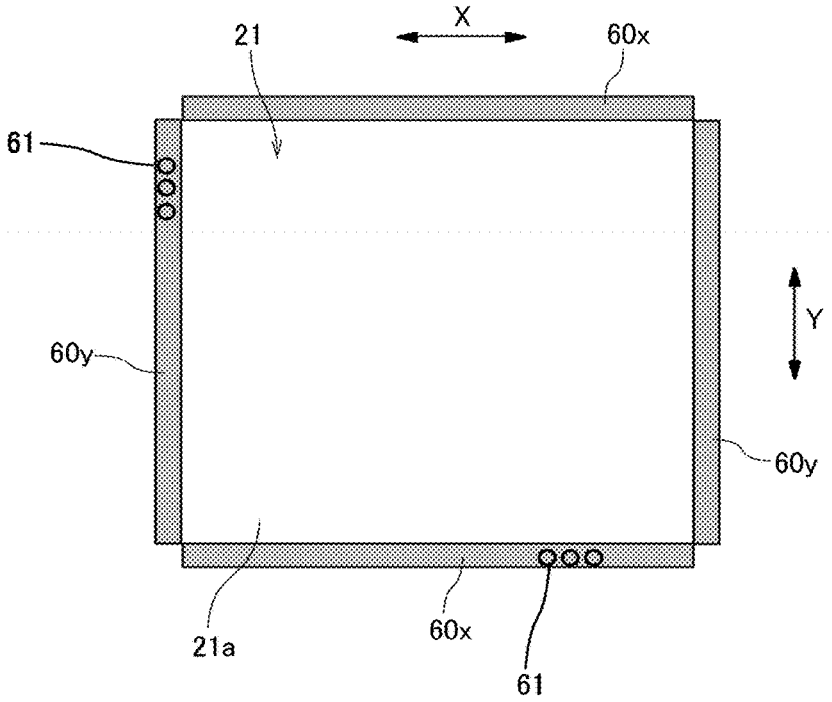
FIG. 3 is a schematic plan view of a bed according to the first embodiment of the present disclosure illustrating a print area indicator.

Next, a print area indicator 60 of the printer 1 according to the present embodiment is described with reference to FIG. 3. FIG. 3 is a schematic plan view of the bed 21 of the printer 1 according to the first embodiment of the present disclosure.

The bed 21 (mount) has a rectangular shape including four peripheral sides. The bed 21 includes X-direction print area indicators 60*x* to indicate a print area in the first direction X (main-scanning direction) on two sides of the bed 21 opposite in the second direction Y among four peripheral sides of the bed 21. The bed 21 includes Y-direction print area indicators 60*y* to indicate a print area in the second direction Y (sub-scanning direction) on two sides of the bed 21 opposite in the first direction X among four peripheral sides of the bed 21.

A print area indicator 60 includes the X-direction print area indicator 60*x* and the Y-direction print area indicator 60*y* configured to include light emitters such as laser emitting diodes (LEDs) 61 side by side.

Figure 4:
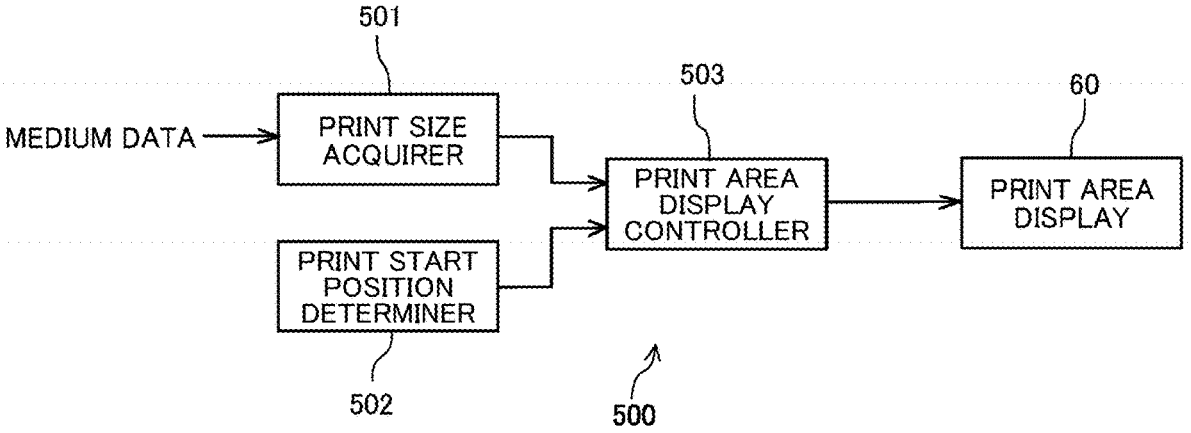
FIG. 4 is a block diagram of a controller to control the print area indicator according to the first embodiment of the present disclosure.

Next, a controller 500 to control the print area indicator 60 according to the first embodiment of the present disclosure is described with reference to a block diagram of FIG. 4.

The controller 500 of the printer 1 includes a print size acquirer 501 that acquires a print size (X, Y) from medium data of the print target 10 input by the user.

The controller 500 further includes a print start position determiner 502 that determines a preset default position or a position input by the user as a print start position (coordinates: X0, Y0).

The print start position determiner 502 may determine the print start position to one of four corners of the bed 21 (mount) in an area mountable the print target 10. The print start position determiner 502 may also determine the print start position to a position input (designated) from an exterior of the printer 1 by the user.

The controller 500 further includes a print area indicator controller 503 that controls the print area indicator 60 to indicate a print area based on size information indicating a print size output from the print size acquirer 501 and an arrangement information (X0, Y0) indicating the print start position determined by the print start position determiner 502.

Each of the functions of the controller 500 and the print area indicator controller 503 may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

Figure 5:
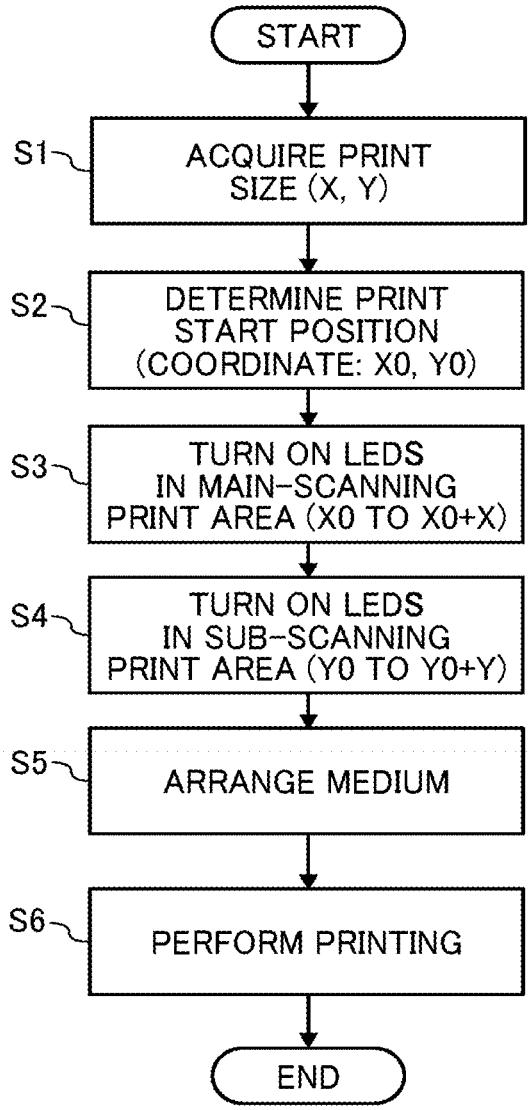
FIG. 5 is a flowchart of a control of a print operation of the controller according to the first embodiment of present disclosure.
Figure 6:
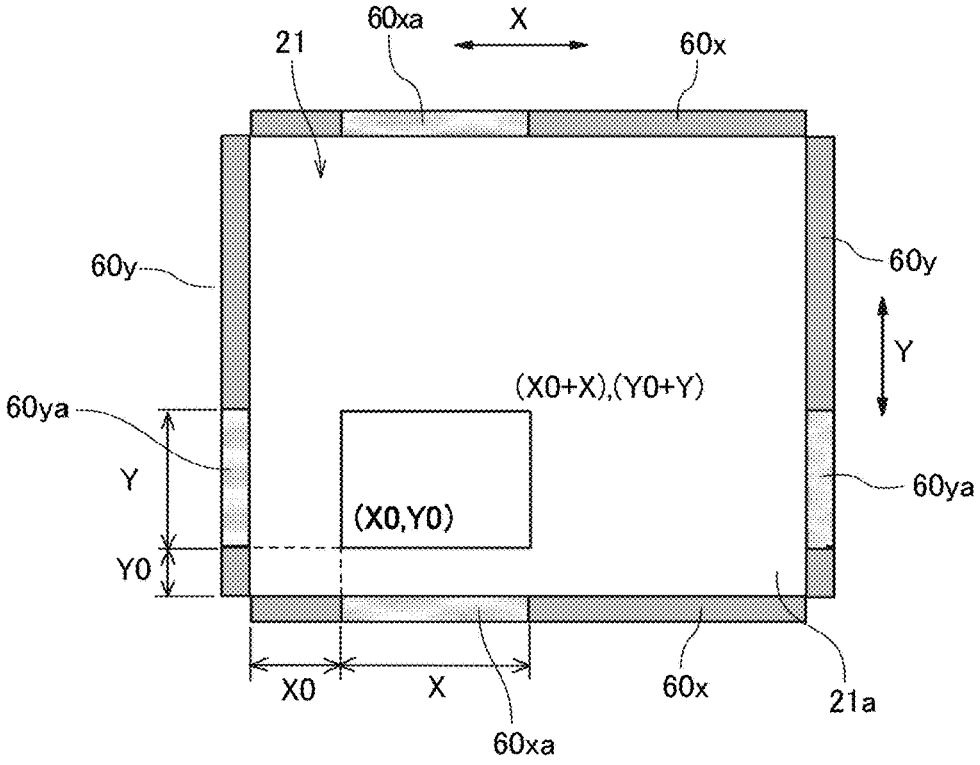
FIG. 6 is a schematic plan view of the bed of the printer according to the first embodiment of the present disclosure.

Next, control of a print operation of the controller 500 is described below with reference to FIGS. 5 and 6. FIG. 5 is a flowchart of the control of the print operation by the controller 500. FIG. 6 is a schematic plan view of the bed 21 of the printer 1 according to the first embodiment to illustrate the print operation.

The print size acquirer 501 pf the controller 500 acquires a print size (X, Y) from the print data (step S1). Hereinafter, the step S1 is also simply referred to as "S1."

Then, the print start position determiner 502 determines the print start position (coordinates: X0, Y0) in step S2.

Then, as illustrated in FIG. 6, the print area indicator controller 503 controls the X-direction print area indicators 60*x* to turn on the LEDs 61, for example, corresponding to a main-scanning print areas (X0 to X0+X) to indicate an X-direction print area 60*xa* (S3).

Similarly, the print area indicator controller 503 controls the Y-direction print area indicators 60*y* to turn on the LEDs 61, for example, corresponding to a sub-scanning print areas (Y0 to Y0+Y) to indicate a Y-direction print area 60*ya* (S4).

Thus, the print area indicator 60 includes an X-direction print area indicator 60*x* at least in one side of the bed 21 (mount), and a Y-direction print area indicator 60*y* at least in another side perpendicular the one side of the bed 21 (mount).

The print area indicator controller 503 controls the X-direction print area indicator 60*x* to indicate the print area (X0 to X0+X) in the first direction (main-scanning direction).

The print area indicator controller 503 controls the Y-direction print area indicator 60*y* to indicate the print area (Y0 to Y0+Y) in the second direction (sub-scanning direction) perpendicular to the first direction, when the print start position in the first direction is X0, and the print start position in the second direction is Y0, and the print size in the first direction is X, and the print size in the second direction is Y.

The bed 21 (mount) has a rectangular shape including four peripheral sides.

The print area indicator 60 includes a plurality of X-direction print area indicators, including the X-direction print area indicator 60*x*, in opposing two sides (upper and lower sides in FIG. 3) of the bed 21 (mount), and a plurality of Y-direction print area indicators 60*y*, including the Y-direction print area indicator 60*y*, in other opposing two sides (left and right sides in FIG. 3) perpendicular to the opposing two sides of the bed 21 (mount).

Therefore, the user can recognize the print area from the X-direction print area 60*xa* in the first direction X (main-scanning direction) and the Y-direction print area 60*ya* in the second direction Y (sub-scanning direction) indicated on the print area indicator 60 so that the user can arranges (places) the print target 10 (medium) on the bed 21 (S5).

Then, the controller 500 performs printing on the print target (S6).

Thus, the printer 1 indicates a print area on the print area indicator 60 arranged around a periphery of the bed 21 (mount) so that the user can visually recognize the print area to accurately arrange the print target 10 on the bed 21. Then, the printer 1 can indicates the print area with a simpler configuration than in a configuration in which a printer including a large-scale indicator such as a camera and projector system.

Figure 7:
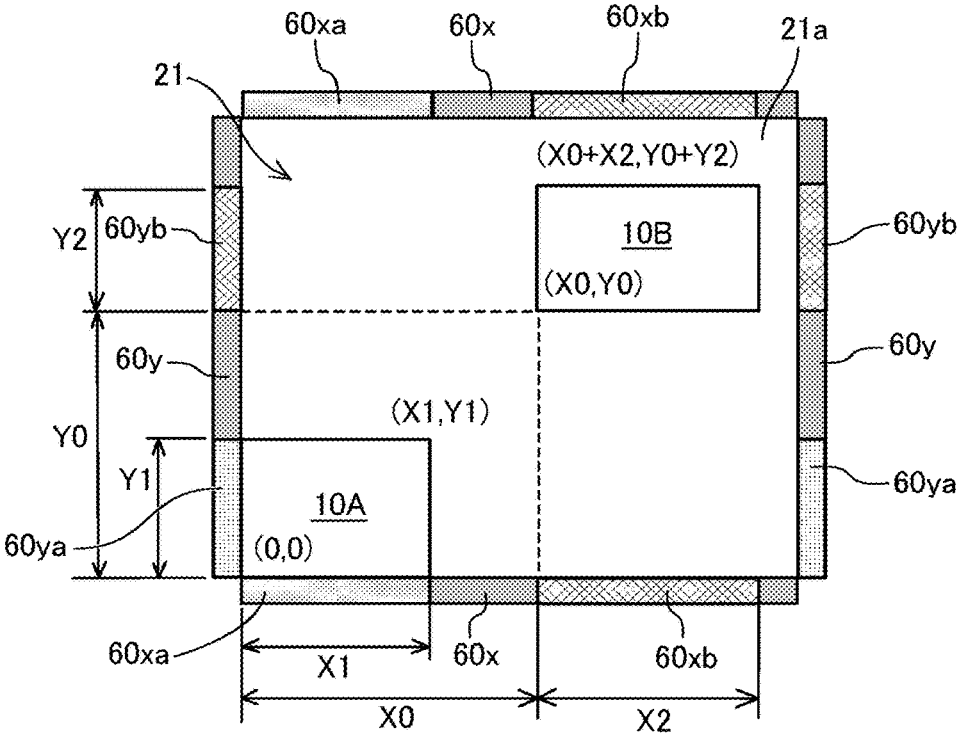
FIG. 7 is a schematic plan view of the bed according to a second embodiment of the present disclosure.

Next, a second embodiment of the present disclosure is described with reference to FIG. 7. FIG. 7 is a schematic plan view of the bed 21 according to the second embodiment of the present disclosure.

The print area indicator 60 (60*x*, 60*y*) of the printer 1 according to the second embodiment uses an indicator indicatable of different colors.

When two print targets 10A and 10B are placed on the bed 21 for printing (see FIG. 7), the controller 500 controls the print area indicators 60 (60*x* and 60*y*) to indicate print areas of the print targets 10A and 10B, respectively, with different colors.

For example, the print start position of the print target 10A is set to coordinates (X0=0, Y0=0), and the print size of the print target 10A is X1 in the first direction X (main-scanning direction) and Y1 in the second direction Y (sub-scanning direction). Then, as illustrated in FIG. 7, the print area indicator controller 503 controls the X-direction print area indicators 60*x* to turn on the LEDs 61 corresponding to a main-scanning print areas (0 to X1) in the X-direction print area indicators 60*x* to indicate an X-direction print area 60*xa*. Similarly, the print area indicator controller 503 controls the Y-direction print area indicators 60*y* to turn on the LEDs 61 corresponding to a sub-scanning print areas (0 to Y1) in the Y-direction print area indicators 60*y* to indicate a Y-direction print area 60*ya*.

The print start position of the print target 10B is set to coordinates (X01, Y01), and the print size of the print target 10B is X2 in the first direction X (main-scanning direction) and Y2 in the second direction Y (sub-scanning direction). Then, as illustrated in FIG. 7, the print area indicator controller 503 controls the X-direction print area indicators 60*x* to turn on the LEDs 61 corresponding to a main-scanning print areas (X01 to X01+X2) to indicate an X-direction print area 60*xb*. Similarly, the print area indicator controller 503 controls the Y-direction print area indicators 60*y* to turn on the LEDs 61 corresponding to a sub-scanning print areas (Y01 to Y01+Y2) to indicate a Y-direction print area 60*yb*.

The print area indicator 60 differentiates light emission colors of the LEDs 61 between the X-direction print area 60*xa* and X-direction print area 60*xb*, and differentiates light emission colors of the LEDs 61 between the Y-direction print area 60*ya* and the Y-direction print area 60*yb* so that the print areas of the print targets 10A and 10B are color-coded to be distinguishably indicated. Thus, the user can visually recognize the print area to accurately arrange the print target 10 on the bed 21.

In each of the above embodiments, the printer 1 includes the print area indicators 60 on each of four sides of the bed 21. However, the printer 1 may include the X-direction print area indicator 60*x* and the Y-direction print area indicator at least in two sides of the bed 21 perpendicular to each other. For example, printer 1 includes one of the X-direction print area indicator 60*x* in the first direction X (main-scanning direction) and one of the Y-direction print area indicator 60*y* in the second direction Y (sub-scanning direction) perpendicular to the one of the X-direction print area indicator 60*x*.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A printer, comprising:

a mount on which a print target is placed;

a print device configured to print an image on the print target on the mount;

a print area indicator around a periphery of the mount, the print area indicator configured to visually indicate a print area of the image to be printed on the print target on the mount; and control circuitry configured to control the print area indicator to visually indicate spatial boundaries of the print area of the image to be printed, the spatial boundaries being determined from a print start position from which the print device starts printing on the print target and a print size of the image to be printed on the print target.

2. The printer according to claim 1, wherein the print area indicator includes:

an X-direction print area indicator at least in one side of the mount; and a Y-direction print area indicator at least in another side perpendicular to the one side of the mount, the control circuitry is configured to control the X-direction print area indicator to indicate the print area (X0 to X0+X) in a first direction, and the control circuitry is configured to control the Y-direction print area indicator to indicate the print area (Y0 to Y0+Y) in a second direction perpendicular to the first direction, wherein the print start position in the first direction is X0, the print start position in the second direction is Y0, the print size in the first direction is X, and the print size in the second direction is Y.

3. The printer according to claim 2, wherein the mount has a rectangular shape including four peripheral sides, and the print area indicator includes:

a plurality of X-direction print area indicators, including the X-direction print area indicator, in opposing two sides of the mount; and a plurality of Y-direction print area indicators, including the Y-direction print area indicator, in other opposing two sides perpendicular to the opposing two sides of the mount.

4. The printer according to claim 3, wherein the control circuitry is further configured to determine the print start position as one of four corners of the mount in an area mountable the print target.

5. The printer according to claim 3, wherein the control circuitry is further configured to determine the print start position from a position input to the printer.

6. The printer according to claim 1, wherein the control circuitry is further configured to control the print area indicator to indicate a plurality of print areas for a plurality of print targets, respectively.

7. The printer according to claim 6, wherein the print area indicator displays a plurality of colors, and the control circuitry is further configured to control the print area indicator to indicate the plurality of print areas for the plurality of print targets with different colors, respectively.

8. The printer of claim 1, wherein the print area indicator includes light sources, and the control circuitry is further configured to control illumination of the light sources based on the print start position and the print size.

9. The printer of claim 1, wherein the print area indicator includes a plurality of light sources that selectively emit light based on the print area of the image.

* * * * *